US009038850B1

(12) United States Patent
Wilson

(10) Patent No.: US 9,038,850 B1
(45) Date of Patent: May 26, 2015

(54) HINGED UNIVERSAL LID FOR A BEVERAGE CONTAINER

(71) Applicant: Keith Wilson, Brooklyn, NY (US)

(72) Inventor: Donovan Wilson, Brooklyn, NY (US)

( * ) Notice: Subject to any disclaimer, the term of this patent is extended or adjusted under 35 U.S.C. 154(b) by 0 days.

(21) Appl. No.: 14/320,740

(22) Filed: Jul. 1, 2014

(51) Int. Cl.
*B65D 47/08* (2006.01)
*A47G 19/22* (2006.01)

(52) U.S. Cl.
CPC ..... *A47G 19/2272* (2013.01); *B65D 47/088* (2013.01)

(58) Field of Classification Search
CPC ..... B65D 47/088
USPC ..... 220/758, 759, 768; 215/396; 294/33
See application file for complete search history.

(56) References Cited

U.S. PATENT DOCUMENTS

| | | | | | |
|---|---|---|---|---|---|
| 2,016,558 | A | * | 10/1935 | Redrup | 220/263 |
| 3,107,029 | A | * | 10/1963 | Rylander | 220/740 |
| 3,708,085 | A | * | 1/1973 | Bumpas | 220/484 |
| 4,312,465 | A | * | 1/1982 | Sinkhorn et al. | 224/414 |
| 4,494,672 | A | * | 1/1985 | Pearson | 220/263 |
| 4,872,577 | A | * | 10/1989 | Smith | 220/739 |
| 6,047,852 | A | | 4/2000 | Bruce | |
| 6,637,618 | B2 | * | 10/2003 | Friederich | 220/845 |
| 7,156,253 | B2 | * | 1/2007 | Ziegler | 220/375 |
| D592,505 | S | | 5/2009 | Mobley et al. | |
| 2006/0231563 | A1 | | 10/2006 | Olivar | |

FOREIGN PATENT DOCUMENTS

WO WO2006138208 3/2009

* cited by examiner

*Primary Examiner* — Steven A. Reynolds
*Assistant Examiner* — King M Chu
(74) *Attorney, Agent, or Firm* — Kyle A. Fletcher, Esq.

(57) ABSTRACT

The beverage container lid assembly includes a clip that may engage a beverage container. A cover is movably coupled to the clip. The cover may close the beverage container. A trigger is coupled to the cover. The trigger is manipulated by a user. The cover is positionable between a closed position and an open position.

17 Claims, 4 Drawing Sheets

HINGED UNIVERSAL LID FOR A BEVERAGE CONTAINER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of hinged universal lids, more specifically, hinged universal lids for a beverage container.

SUMMARY OF THE INVENTION

An embodiment of the disclosure meets the needs presented above by generally comprising a clip that may engage a beverage container. A cover is movably coupled to the clip. The cover may close the beverage container. A trigger is coupled to the cover. The trigger is manipulated by a user. The cover is positionable between a closed position and an open position.

An object of the invention is to provide a device that is hinged universal lid for a beverage container.

These together with additional objects, features and advantages of the hinged universal lid for a beverage container upon reading the following detailed description of presently preferred, but nonetheless illustrative, embodiments of the hinged universal lid for a beverage container when taken in conjunction with the accompanying drawings.

In this respect, before explaining the current embodiments of the hinged universal lid for a beverage container in detail, it is to be understood that the hinged universal lid for a beverage container is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hinged universal lid for a beverage container.

It is therefore important that the claims be regarded as including such equivalent construction insofar as they do not depart from the spirit and scope of the hinged universal lid for a beverage container. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
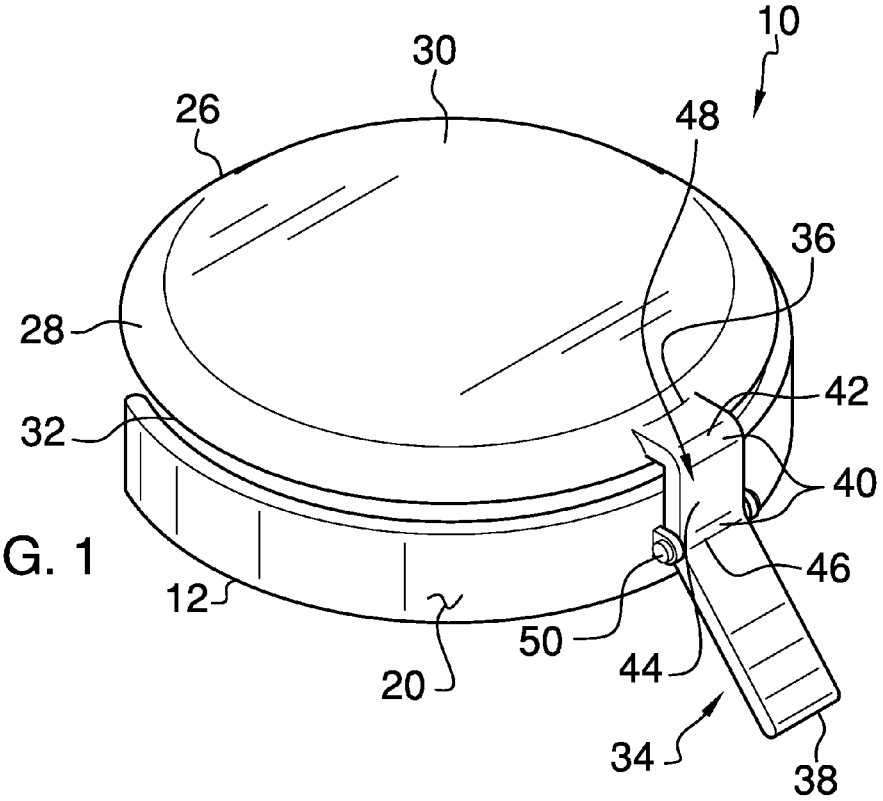
FIG. 1 is a top perspective view of a beverage container lid assembly according to an embodiment of the disclosure.
Figure 2:
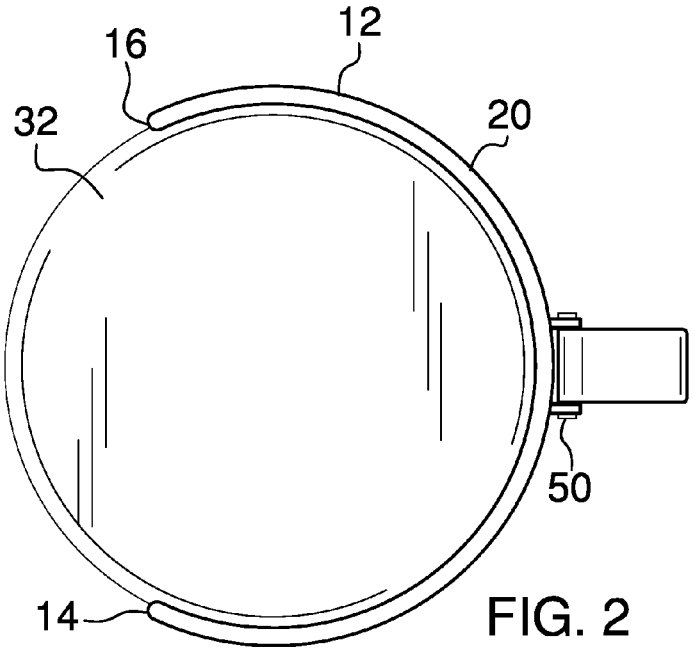
FIG. 2 is a bottom view of an embodiment of the disclosure.
Figure 3:
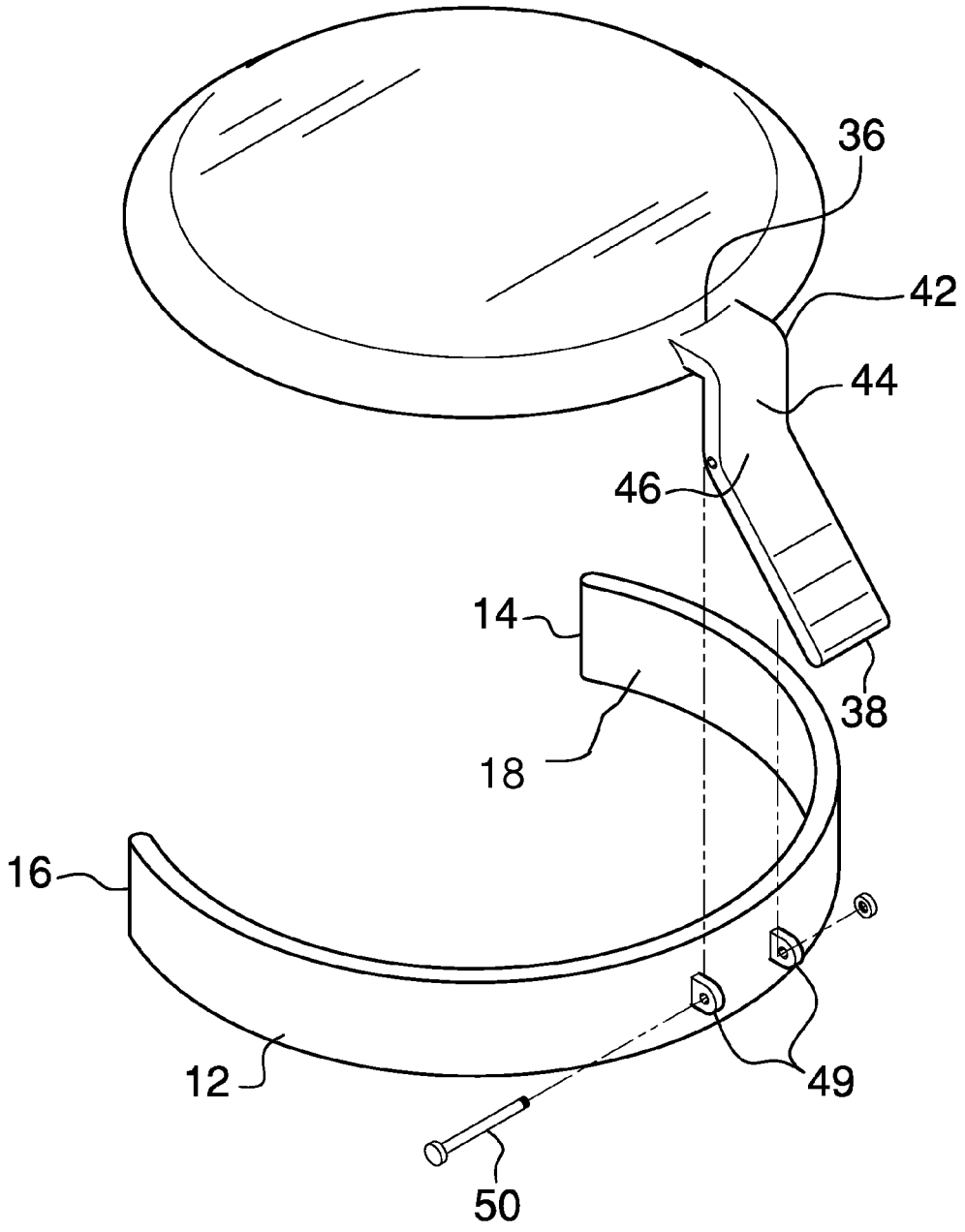
FIG. 3 is an exploded perspective view of an embodiment of the disclosure.
Figure 4:
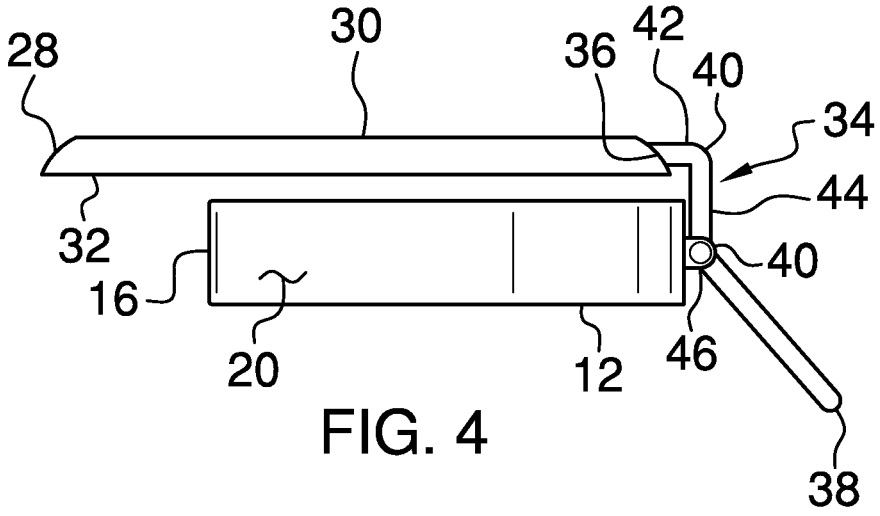
FIG. 4 is a left side view of an embodiment of the disclosure.
Figure 5:
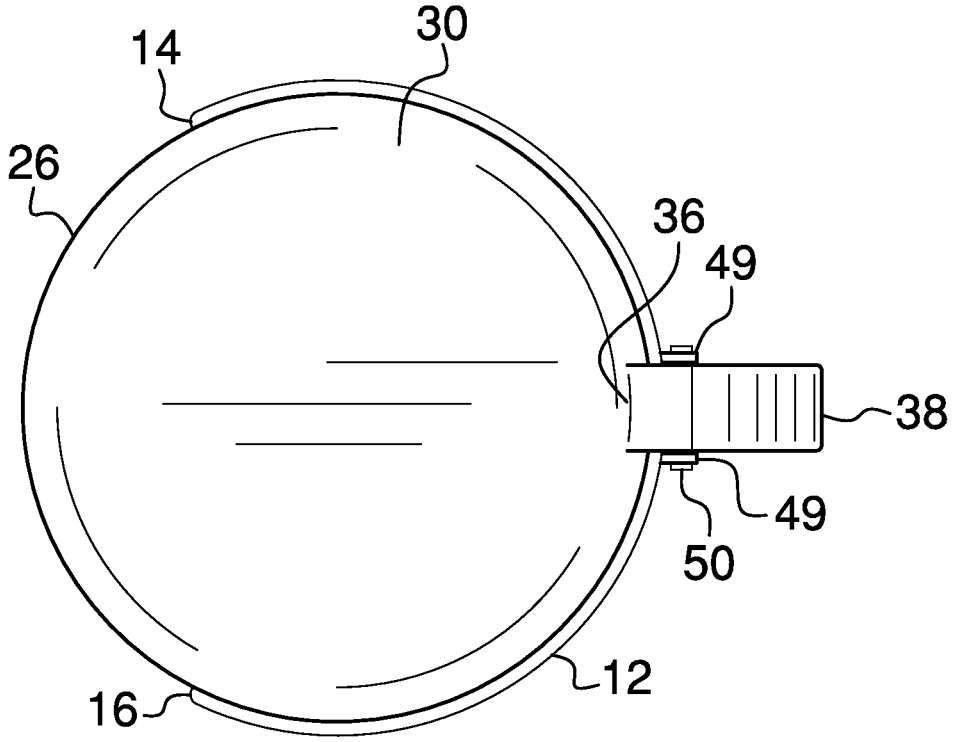
FIG. 5 is a top view of an embodiment of the disclosure.
Figure 6:
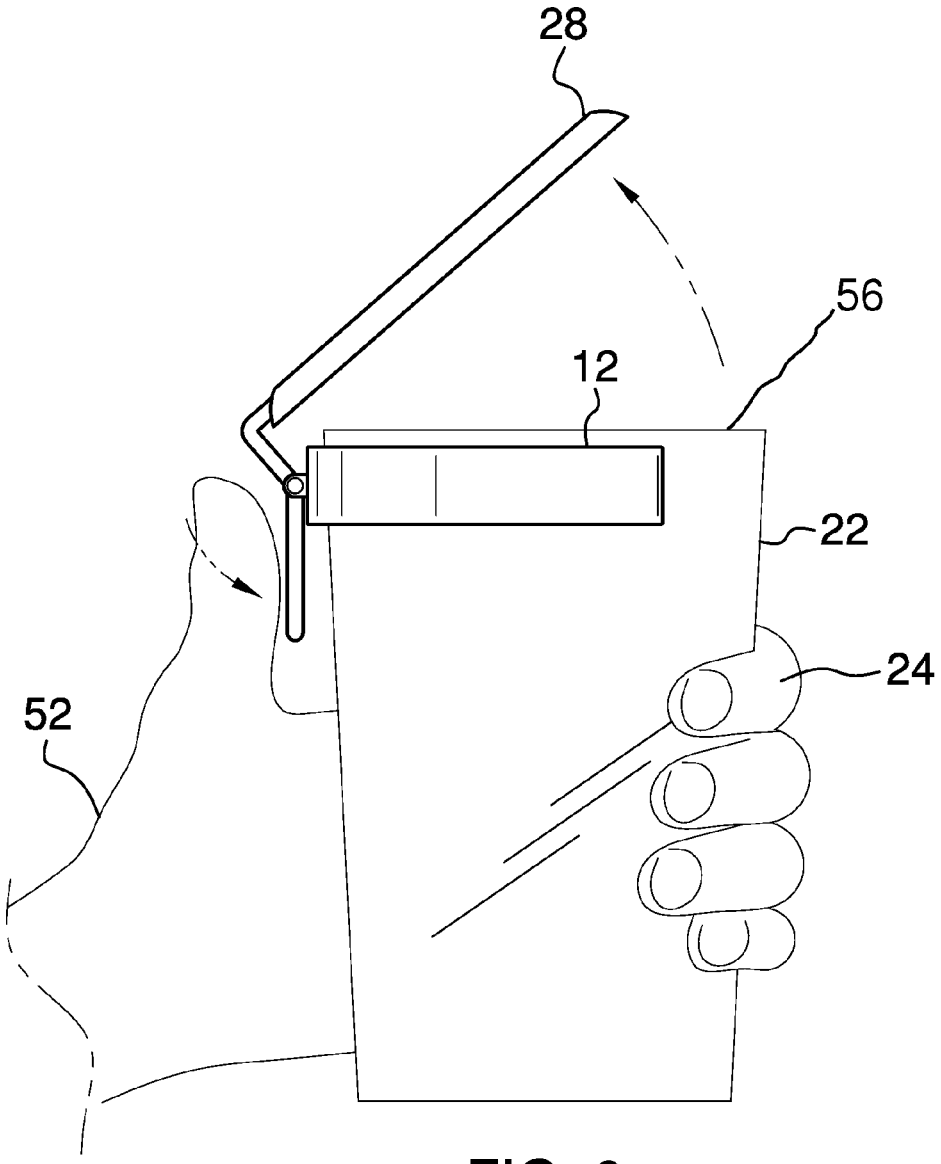
FIG. 6 is an in-use view of an embodiment of the disclosure.

As best illustrated in FIGS. 1 through 6, the beverage container lid assembly 10 generally comprises a clip 12 that has a first end 14 and a second end 16. The clip 12 is elongated between the first 14 and second 16 ends of the clip 12. Each of a front 18 and a back 20 surface of the clip 12 is curvilinear with respect to each other. The clip 12 has a semi-circular shape.

The clip 12 is positionable around a beverage container 22. The front surface 18 of the clip 12 abuts an outer wall 24 of the beverage container 22. The clip 12 is retained on the beverage container 22. Additionally, the beverage container 22 may be a cylindrical beverage container of any conventional design.

A cover 26 is provided. The cover 26 has an outer edge 28 extending between a top side 30 and a bottom side 32 of the cover 26. The outer edge 28 of the cover 26 is curvilinear. Moreover, the cover 26 has a disk shape.

A trigger 34 has a coupled end 36 and a free end 38. The trigger 34 has a pair of bends 40 thereon. A first one 42 of the pair of bends 40 is positioned proximate the coupled end 36 of the trigger 34. The coupled end 36 of the trigger 34 is directed away from a body 44 of the trigger 34 at a right angle. A second one 46 of the pair of bends 40 is positioned proximate a middle 48 of the trigger 34. The free end 38 of the trigger 34 is directed away from the body 44 of the trigger 34 at an obtuse interior angle.

The coupled end 36 of the trigger 34 is coupled to the outer edge 28 of the cover 26. The trigger 34 extends downwardly from the cover 26. A pair of tabs 49 is coupled to and extends away from the outer edge 28 of the cover 26. The trigger 34 is positioned between the pair of tabs 49. A pin 50 extends laterally through the trigger 34 proximate the second bend 46 of the trigger 34. The pin 50 engages the pair of tabs 49 so the cover 26 is hingedly coupled to the clip 12.

The free end 38 of the trigger 34 is directed away from the clip 12. A user 52 engages the trigger 34 proximate the free end 38 of the trigger 34. The trigger 34 is manipulated to position the cover 26 between a closed position and an open position.

The bottom side 32 of the cover 26 abuts a top edge 56 of the beverage container 22 when the cover 26 is positioned in the closed position. The cover 26 completely closes the beverage container 22 in the closed position. The cover 26 extends upwardly from the clip 12 when the cover 26 is positioned in the open position.

In use, the clip 12 is positioned around the beverage container 22 proximate the top edge 56 of the beverage container 22. The cover 26 is placed in the closed position to prevent foreign matter from entering the beverage container 26. The cover 26 is placed in the open position so the user 52 may drink from the beverage container 22.

With respect to the above description, it is to be realized that the optimum dimensional relationship for the various components of the beverage container lid assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the beverage container lid assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A beverage container lid assembly configured to be coupled to a beverage container such that the beverage container is selectively closable, said assembly comprising:

a clip configured to engage the beverage container;

a cover movably coupled to said clip such that said cover is configure to close the beverage container;

a trigger coupled to said cover, said trigger being manipulated by a user such that said cover is positionable between a closed position and an open position;

wherein said cover having an outer edge extending between a top side and a bottom side of said cover;

wherein said outer edge of said cover being curvilinear such that said cover has a disk shape.

2. The assembly according to claim 1, wherein said clip having a first end and a second end.

3. The assembly according to claim 2, wherein said clip being elongated between said first and second ends of said clip.

4. The assembly according to claim 1, wherein each of a front surface and a back surface of said clip being curvilinear with respect to each other.

5. The assembly according to claim 4, wherein said clip has a semi-circular shape.

6. The assembly according to claim 1, wherein said clip being positionable around the beverage container such that a front surface of said clip abuts an outer wall of the beverage container.

7. The assembly according to claim 1, wherein said trigger having a coupled end and a free end.

8. The assembly according to claim 1, wherein said trigger having a pair of bends thereon.

9. The assembly according to claim 8, wherein a first one of said pair of bends being positioned proximate a coupled end of said trigger.

10. The assembly according to claim 8, wherein a second one of said pair of bends being positioned proximate a middle of said trigger such that said trigger has a Z-shape.

11. The assembly according to claim 1, wherein a coupled end of said trigger being coupled to an outer edge of said cover.

12. The assembly according to claim 1, wherein a pin extending laterally through said trigger proximate a second bend of said trigger and engaging said clip such that said cover is hingedly coupled to said clip.

13. The assembly according to claim 1, wherein a free end of said trigger being directed away from said clip such that a user may engage said trigger.

14. A beverage container lid assembly configured to be coupled to a beverage container such that the beverage container is selectively closable, said assembly comprising:

a clip having a first end and a second end, said clip being configured to engage the beverage container;

a cover movably coupled to said clip such that said cover is configure to close the beverage container;

a trigger coupled to said cover, said trigger being manipulated by a user such that said cover is positionable between a closed position and an open position;

wherein said cover having an outer edge extending between a top side and a bottom side of said cover; said outer edge of said cover being curvilinear such that said cover has a disk shape; said trigger having a coupled end and a free end.

15. The assembly according to claim 14, wherein said clip being elongated between said first and second ends of said clip; each of a front surface and a back surface of said clip being curvilinear with respect to each other wherein said clip has a semi-circular shape; said clip being positionable around the beverage container such that said front surface of said clip abuts an outer wall of the beverage container.

16. The assembly according to claim 14, wherein said trigger having a pair of bends thereon; a first one of said pair of bends being positioned proximate a coupled end of said trigger; a second one of said pair of bends being positioned proximate a middle of said trigger such that said trigger has a Z-shape.

17. The assembly according to claim 14, wherein a coupled end of said trigger being coupled to an outer edge of said cover; a pin extending laterally through said trigger proximate a second bend of said trigger and engaging said clip such that said cover is hingedly coupled to said clip; a free end of said trigger being directed away from said clip such that a user may engage said trigger.

* * * * *